United States Patent [19]

Mainhardt

[11] Patent Number: 4,728,037

[45] Date of Patent: Mar. 1, 1988

[54] SAFE, EFFECTIVE SELF-DEFENSE DEVICE

[75] Inventor: Robert Mainhardt, Danville, Calif.

[73] Assignee: Trebor Corporation, Dublin, Calif.

[21] Appl. No.: 898,745

[22] Filed: Aug. 18, 1986

Related U.S. Application Data

[63] Continuation of Ser. No. 546,904, Oct. 31, 1983, abandoned.

[51] Int. Cl.[4] ..... B05B 11/04

[52] U.S. Cl. ..... 239/154; 220/85 CH; 222/212; 222/491; 222/543; 239/327

[58] Field of Search ..... 239/327, 152–154; 424/195, 315; 222/491, 541, 211, 212, 215, 175, 543; 220/85 CH, 85 H; 206/216

[56] References Cited

U.S. PATENT DOCUMENTS

| | | | |
|---|---|---|---|
| 2,171,701 | 9/1939 | Howett | 424/10 |
| 2,297,690 | 10/1942 | Nitardy | 222/491 X |
| 2,578,907 | 12/1951 | Tupper | 239/327 X |
| 2,629,516 | 2/1953 | Badham | 239/327 X |
| 2,876,935 | 3/1959 | Lindberg | 239/327 X |
| 3,118,573 | 1/1964 | Johnson | 222/491 X |
| 3,450,313 | 6/1969 | Jonas | 222/175 X |
| 3,583,602 | 6/1971 | Gruber | 239/327 X |
| 4,241,850 | 12/1980 | Speer | 239/154 X |

FOREIGN PATENT DOCUMENTS

| | | | |
|---|---|---|---|
| 258012 | 5/1963 | Australia | 222/543 |
| 2436454 | 5/1980 | France | 424/10 |

*Primary Examiner*—Andres Kashnikow

*Attorney, Agent, or Firm*—Flehr, Hohbach, Test, Albritton & Herbert

[57] ABSTRACT

A safe, effective self-defense device including a container having a non-toxic deterrent fluid mixture therein is disclosed. The container is provided as a thin-walled, manually-collapsible, squeeze bottle having a nozzle, a nozzle closure cap and a sealing substance positioned in the nozzle, which cap can be removed and the sealing substance ejected from the nozzle by a single hand of the user. The deterrent mixture includes a surfactant lachyrmal agent, a food-grade dye and an odor or oleofactory agent.

3 Claims, 3 Drawing Figures

SAFE, EFFECTIVE SELF-DEFENSE DEVICE

This application is a continuation, of application Ser. No. 546,904, filed Oct. 31, 1983, now abandoned.

BACKGROUND OF THE INVENTION

There have been various attempts to devise safe and yet effective self-defense devices for the relatively untrained user. One of the more widely known, and yet not widely used, self-defense devices is the tear gas (CS or CN) canister or cartridge. Typical of such cartridges are the personal self-defense devices sold under the trademark MACE. Tear gas chemicals, however, are not well understood by the average user, and there is considerable fear and confusion attached to their possession and use by private individuals. Additionally, it is not practical for most people to practice using tear gas canisters, and they are not effective against dogs. At least four states in the United States have specific and detailed legislation limiting or prohibiting use of tear gas canisters, and carrying tear gas onto commercial airliners is federally prohibited. Typical of prior art self-defense apparatus which have been devised to discharge tear gas are the devices set forth in U.S. Pat. Nos. 1,598,784 and 3,235,992.

Although tear gas, when properly used, can be highly effective in detering crimes against the person, there has been considerable effort to develop alternative chemical-based self-defense devices which would have the mass appeal necessary to significantly reduce crime. Among the proposed alternative solutions to the use of tear gas are self-defense apparatus which discharge ammonia (U.S. Pat. No. 599,383), a lachrymal agent such as red pepper (U.S. Pat. No. 3,084,466), dye (U.S. Pat. Nos. 3,053,416 and 3,706,151), and dye and odor agents (U.S. Pat. Nos. 2,432,791 and 4,223,804).

These prior art self-defense devices discharge or disperse the various substances through a variety of techniques, but most often they include an aerosol gas, an explosive device or an elaborate mechanical system. Most of the delivery systems have been inherently complex and therefore undesirably costly or they have lacked the ability to be quickly and reliably deployed and yet not accidentally discharged. Most tear gas self-defense devices also have cost, range and payload disadvantages, as well as limitations as to use through a full range of spatial orientations. Moreover, some of the prior art deterrent agents not only have a deterrent effect, but they can have permanent toxic side effects. Thus, not only is the criminal attacker potentially exposed to permanent damage, but the person defending him or herself can also be exposed to the deterrent agent and its side effects.

Most chemical-based, self-defense devices have for the primary purpose the deterrent of attackers. To this end, lachrymal agents and odor agents are particularly effective in disabling and discouraging an attacker. Additionally, however, it has been found highly advantageous to have a self-defense device which will also assist the police, authorities or witnesses in identifying the attacker at a later time. Tear gas to a limited extent does redden the skin, but the effects are not very long lasting and vary considerably from person to person. Self-defense devices which include dyes or odor agents, however, can be quite helpful in allowing the authorities to identify and attacker, particularly if the suspect is captured relatively soon after the attack.

OBJECTS AND SUMMARY OF THE INVENTION

A. Objects of the Invention

Accordingly, it is an object of the present invention to provide a simple self-defense device which will be highly effective as a deterrent and yet is safe and can be easily, quickly and effectively operated by unskilled personnel.

Another object of the present invention is to provide a safe, effective self-defense device which will inflict reversible and temporary physical discomfort to the attacker.

Another object of the present invention is to provide a self-defense device which is safe and effective and yet inexpensive to produce, reliable, compact and easy to carry.

It is a further object of the present invention to provide a safe, effective chemical-base self-defense device which includes an odor agent as well as a dye or marking agent to assist in tracking and identification of an attacker.

Another object of the present invention is to provide a self-defense device for dispensing a deterrent liquid mixture which is not materially affected by wind, is effective against animals, as well as humans and can optionally include a light to enhance the effectiveness of its use at night.

The self-defense device of the present invention has other objects and features of advantage which will become more apparent from and are set forth in more detail in the accompanying drawing and following description of the preferred embodiment.

B. Summary of the Invention

The safe, effective, self-defense device of the present invention includes container means and a deterrent fluid disposed in the container means, with the container means including manually activatable fluid dispensing means formed to enable selective discharge of the deterrent fluid by a user for self-defense purposes. The improvement in the self-defense device comprises, briefly, the container being formed of a flexible material having sufficiently thin walls to enable collapsing of the container by one hand of the user to effect repeated squeeze-controlled discharges of the deterrent fluid, the dispensing means being provided by a nozzle formed to produce a coherent stream of fluid upon manual collapsing of the container, and nozzle sealing and closure means mounted to the nozzle and formed for removal from the nozzle and discharge of the fluid by use of only one hand of the user. The apparatus provides greater payload per unit volume because no propellant is required; the flexible container walls provide the payload propelling mechanism. In another aspect of the present invention, the deterrent fluid includes a surfactant lachrymal agent and preferably an anionic surfactant. The deterrent mixture further preferably includes a food-grade dye. and a non-toxic odor agent. Optionally, a flashlight can be releasably secured to the collapsible container so that during collapse of the container the user can simultaneously actuate the light.

DESCRIPTION OF THE PREFERRED EMBODIMENT

Figure 1:
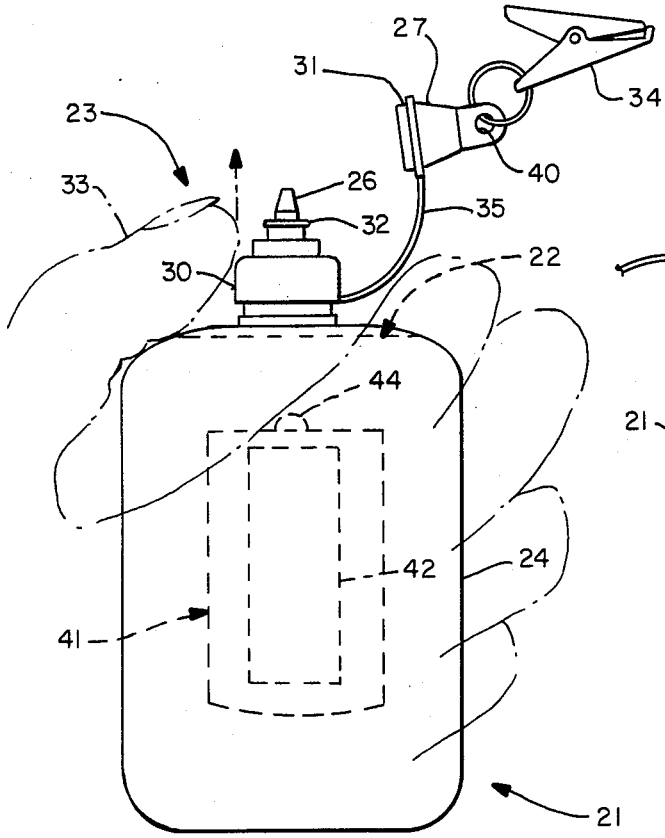
FIG. 1 is a front elevational view of a self-defense device constructed in accordance with the present invention.

The self-defense device of the present invention can be seen from the drawing to include container means, generally designated 21, and a deterrent fluid 22 disposed in the container. The container further includes manually activatable fluid dispensing means, generally designated 23, formed to enable selective discharge of the deterent fluid by the user for use in self-defense applications. These elements are broadly known in the prior art, and do not form a novel portion of the self-defense apparatus of the present invention.

In order to provide a low-cost self-defense apparatus which can be easily activated and used by unskilled personnel, the improved self-defense device of the present invention includes a container which is formed of a flexible material having sufficiently thin walls 24 to enable collapsing of the walls of the container by one hand of the user to effect discharge of deterrent fluid 22. Additionally, dispensing means 23 is provided by nozzle means 26 formed to produce a coherent stream of fluid upon manual collapsing of walls 24 of the container. Nozzle 26 is formed as a discharge conduit having nozzle opening or outlet portion 38 and a nozzle inlet portion 49 with an intermediate nozzle throat 29 of reduced diameter is disposed therebetween. Moreover, a dispensing means 23 further includes nozzle sealing and closure means (preferably comprised of a cap 27 and a sealing material 28 disposed downstream of inlet portion 49 and preferably substantially entirely in nozzle throat 29) formed to prevent accidental discharge of deterrent fluid from container 21 and formed for rapid removal from nozzle 26 and discharge of the deterrent fluid by use of the same hand employed to collapse the container. Sealing material 28 also prevents accidental drops or discharge of fluid on the user.

Instead of attempting to employ a metallic reservoir for a compressed gas, a combustible propellant, mechanical springs or a piston and cylinder arrangement, the self-defense device of the present invention employs a relatively thin-walled squeeze bottle which can be easily collapsed by one hand of a user having ordinary strength so as to expell the deterrent fluid rapidly from the container. In the preferred form, container 21 is formed with walls 24 having a wall thickness in a range of about 0.010 to about 0.030 inches (0.25 to 0.75 millimeters) of a thermoplastic material. Most preferably the material is a low-density linear polyethylene. Such a thin-walled polyethylene squeeze bottle is sufficiently thin so that it can be readily collapsed. Thus, container 21 can be used to discharge virtually all of deterrent fluid 22, even vertically, which cannot be accomplished by thick, less-flexible bottles or containers. Container 21, however, is sufficiently thick to prevent bursting of the container if it is accidentally dropped, sat upon, etc.

Figure 3:
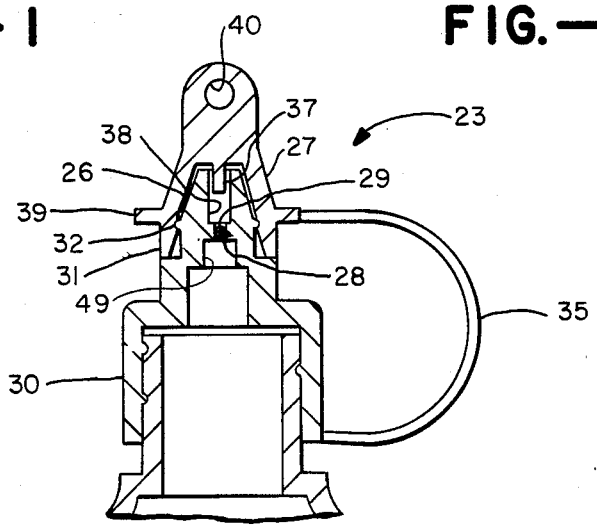
FIG. 3 is an enlarged, fragmentary, front-elevational view corresponding to FIG. 1 of the nozzle and nozzle closure of the self-defense device of the present invention.

Collapsible or squeezable containers are known in the prior art for the dispensing of fluids, but they have not been employed or constructed to facilitate a panic or rapid discharge of a deterrent fluid to provide a self-defense device. Moreover, such squeeze bottles often include involved or relatively complicated and cumbersome nozzle structures, for example as are shown in U.S. Pat. Nos. 3,050,217 and 4,200,097. Nozzle means 26 of the present invention is formed, as best may be seen in FIG. 3, for discharge of a coherent continuous and sustained stream of fluid. Nozzle 26 does not produce a fog or mist, but instead a stream which can be painted on or over a subject at 10 to 20 feet (3 to 6 meters). This allows the user to follow the stream visually, even in the dark with flashlight 41 (as explained hereafter), and easily direct the same into the facial area and forehead of the attacker.

Depending upon the viscosity of the deterrent fluid and its surface tension and the nozzle construction, it is preferable that nozzle 26 be formed with a nozzle throat or opening 29 which is about 0.025 to 0.045 inches (0.6 to 1.15 millimeters) in diameter. The nozzle of FIG. 3 with the preferred form of the deterrent fluid, which will be hereinafter described in more detail, is capable of producing a stream which will reach 20 feet (6 meters) and still remain relatively coherent when container 21 is squeezed with one hand by the user. The coherence of the stream not only aids direction of the same, but makes the stream resistent to wind deflection, which has been a problem with self-defense devices which produce fogs or mists.

In order to enable rapid deployment and use of the self-defense device of the present invention, it is further preferable that the nozzle sealing and closure means 23 be formed for rapid removal from the device by using only one hand, namely, the hand which will squeeze the container to discharge the deterent fluid. This can most advantageously be accomplished by disposing a sealing substance 28, which is inert to deterrent fluid 22, in nozzle 26 so as to seal the nozzle against leakage of the deterrent fluid.

The sealing substance, however, must also be formed so that it can be expelled from the nozzle upon rapid collapsing of the container walls 24. Such a sealing substance 28 may advantageously be provided by a silicon grease, such as silicon grease manufactured by Western Silicon Products and sold under the trademark WSP COMPOUND 211. Such grease is chemically inert and will remain lodged in the nozzle throat over a wide range of temperatures. Upon application of pressure to the grease seal 28, however, it will be expelled from the nozzle throat after a very short delay (a second or less).

Additionally, the closure and sealing means preferably includes a cap 27 which is removably mounted to the nozzle and thereby formed to prevent inadvertent expulsion of sealing grease 28 while the cap is mounted on nozzle 26. Cap 27 can include a resiliently displaceable skirt 31 formed with a shoulder therein that can be snapped into mating engagement with a nozzle shoulder or rib 32 on the exterior of nozzle 26. Cap 27 preferably includes a pin 37 which extends into nozzle opening 38 to form a secondary seal enabling grease seal 28 to act as the primary seal against hydrostatic pressures.

Figure 2:
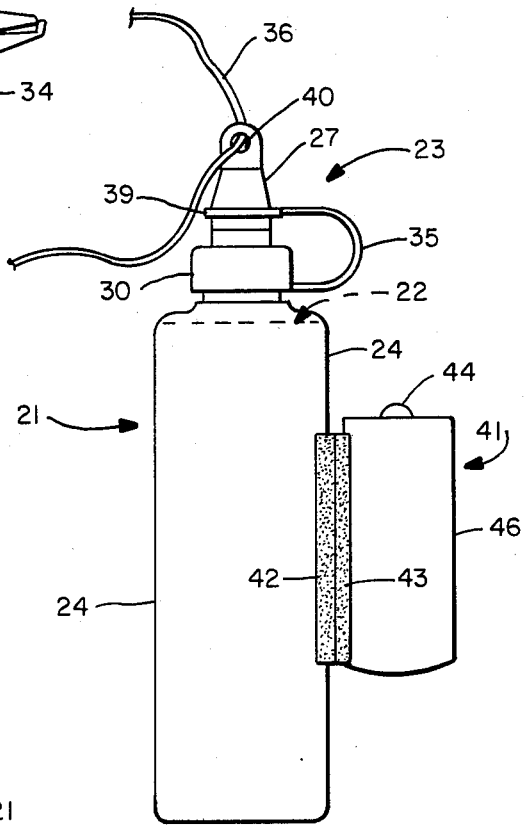
FIG. 2 is a side elevational view of the device of FIG. 1 with a lanyard attached to the nozzle closure cap instead of the clip of FIG. 1.

As best may be seen in FIG. 1, cap 27 can be readily popped off of the top of nozzle 26 by use of the thumb 33 of the user which engages annular flange 39 on the cap while the user grips container 21. Alternatively, cap 27 can include securement means, such as a clip 34 in FIG. 1, or a lanyard 36 as shown in FIG. 2. Clip 34 can be clipped to the clothing of the user and lanyard or a chain 36 can pass around the neck of the user so that the container hangs from the front of the user in the area of the chest. The user can then grab container 21 and pull it away from the securement clip or lanyard which is secured to or passes through opening 40 in the cap to thereby pop the cap off. Squeezing of the container will expell grease seal 28, since the cap is gone, and the deterent fluid can be discharged in a coherent stream toward the attacker.

Additionally, in order to enhance use of the self-defense device of the present invention at night, it is advantageous to include light means, generally designated 41, removably mounted to container 24. This may be accomplished by providing an area 42 of hook and loop fastener mounted to a side wall 24 of the container and a second area 43 of such fastener mounted to flashlight 41. The hook and loop fastener is commercially widely available under the trademark VELCRO. It is preferable that area 42 be an area of hook fasteners so that area 42 can also be used as a way of temporarily securing the container to clothing or fabric containing loops. A mating loop area 43 of fasteners can be mounted to flashlight 41 or some other object such as a keychain.

Flashlight 41 further preferably is a flashlight in which the actuation of the light 44 is accomplished by squeezing side walls 46. Such flashlight structures are well known and described in more detail in U.S. Pat. No. 3,796,869. Mounted as shown in FIGS. 1 and 2, the flashlight in effect is in series with the bottle so that a squeezing of the container and flashlight together will produce a focused light beam and a stream simultaneously. The user can therefore illuminate the area, and particularly the coherent stream produced by the device, so as to enable directing the same most effectively against an attacker. If desired, although it is not required, the deterrent mixture can include a light reflective particulate to further enhance visual perception of the stream at night.

A very important aspect of the self-defense device of the present invention is the effectiveness and yet non-toxic nature of the deterrent fluid mixture. It is known in the prior art to use a deterrent fluid mixture which includes at least one of a lachrymal agent, a dye and an odor agent, and sometimes combinations of the same, as a deterrent fluid mixture. Such prior art deterrent fluids, however, have been found to either lack overall effectiveness or have undesirable toxic side-effects.

The improved deterrent fluid mixture of the present invention includes a lachrymal agent which is highly effective in producing tears to thereby distract an attacker, and yet is non-toxic and will not permanently injure the attacker. The preferred lachrymal agent is a surfactant, and preferably an anionic surfactant such as a sulfonated fatty alcohol of the type commonly found in shampoos. Non-ionic surfactants also will suffice and tend to be the least toxic to human tissues, but they have water solubility disadvantages.

In the most preferred form, the deterrent mixture of the present invention includes about 40 to 50 percent Stepanol WAC (sodium lauryl sulfate), which is a 29 percent active sulfonated fatty alcohol commonly used in commercial shampoos. The surfactant will act as an eye irritant in the same manner as is commonly experienced when shampoo comes in contact with the eye of a user. While it acts as an eye irritant and lachrymal agent, it does not permanently effect the attackers eyes. Using the Draize Technique, the preferred deterrent mixture of the present invention will be well within safe ranges established by The Consumer Products Safety Commission.

Other surfactants usable in the deterrent mixture of the present invention are ammonium laurel sulfate and TEA laurel sulfate. It is preferable that the deterrent mixture including the surfactant should cause some pain to the eye of the attacker in addition to causing tearing so that the attacker will be immobilized for a longer period of time.

Deterrent mixture 22 of the present invention further preferably includes a food-grade dye and a non-toxic odor agent. The dye can be selected from the group consisting of Red Dye No. 3, Red Dye No. 40, Rose Bengal dye and fluorescein dye. All of these dyes are safe and the fluorescein and Rose Bengal dyes are used routinely by ophthalmologists in the eye. Other brilliant or distinguishing dyes can also be employed.

One advantage of using a mixture Red Dye No. 3 and Red Dye No. 40 is that if substantially equal quantities of these two dyes are employed, the resultant mixture has a color approximating the color of blood. There is, therefore, not only a marking effect, but a deterrent or psychological distraction effect as a result of the blood red color. The red dyes are numbered in accordance with well-known Food, Drug and Cosmetic standards and are commercially available under those designations.

Deterrent mixture 22 also preferably includes a non-toxic odor agent. One safe odor agent which can be advantageously employed is mustard oil which acts as an irritant, lachrymal agent and oleofactory deterrent. It is also possible to use other odor agents such as cherry extract which provide a heavy, long duration immediately recognizable odor. Other odor agents include cucumber extract, skunk extract and butyl mercapton. All of these agents distract the attacker and will aid law enforcement authorities in tracking and identification.

In order to enable maximum distraction, tracking and identification, liquid deterrent mixture 22, therefore, is preferably formed with the following formulation:

| Agent | Percent By Weight |
|---|---|
| Stepanol-WAC | 46.33 |
| Water | 23.17 |
| Propylene Glycol | 23.17 |
| FD & C Red No. 40 | 0.39 |
| FD & C Red No. 3 | 0.35 |
| Mustard Oil | 3.23 |
| Poly Sorbate 80 | 3.23 |
| Methyl Paraben | 0.097 |
| Propyl Paraben | 0.006 |
| Dowcil 200 | 0.032 |

Other deterrent mixtures can utilize the following base:

| Agent | Percent By Weight |
|---|---|
| Stepanol WAC | 49.53 |
| Water | 24.77 |
| Propylene Glycol | 24.77 |
| FD & C Red No. 40 | 0.41 |
| FD & C Red No. 3 | 0.37 |
| Methyl Paraben | 0.10 |
| Propyl Paraben | 0.007 |
| Dowcil 200 | 0.03 |

Preservatives suitable for use in the mixture of the present invention are methyl paraben, propyl paraben and Dowcill 200, and these preservatives are to prevent mold growth and bacteria attack of the deterrent mixture. Propylene glycol has been added as a stabilizer to resist temperature extremes from −40° to 167° F.

It should be noted that the deterrent mixture of the present invention is highly effective against animals, which is not the case with tear gas. Because the deterrent mixture of the present invention includes oleofactory mucous membrane agents, it is particularly well suited for use against animals. Certain animals are not always sensitive to tear gas and yet their sense of smell will be attacked by the deterrent mixture of the present invention.

What is claimed is:

1. A safe, effective self-defense device including container means, and a deterrent fluid including at least one of a lachrymal agent, a dye and an olefactory agent disposed in said container means, said container means being formed of a flexible material having sufficiently thin walls to enable collapsing at said walls by one hand of a user to enable selective discharge of said deterrent fluid by said user for self-defense, wherein the improvement in said self-defense device comprises:

said container means being provided with nozzle means having an inlet portion, an outlet portion and a throat portion of reduced diameter disposed therebetween, said nozzle means being formed to produce a coherent stream of said fluid upon manual collapsing of the walls of said container means; and nozzle sealing and closure means mounted to said nozzle means and including cap means mounted to said nozzle means and a sealing substance positioned in said throat portion downstream of said inlet portion of said nozzle means, said nozzle sealing and closure means being formed to prevent accidental discharge of said deterrent fluid from said container means, and said cap means further being formed for rapid removal from said nozzle means with the hand of the user used to collapse said walls and said sealing substance being selected for rapid ejection from said throat portion and said nozzle means upon collapsing of said container for discharge of said deterrent fluid through said nozzle means after ejection of said sealing substance upon continued collapsing of said container by the user.

2. The self-defense device as defined in claim 1 wherein, said deterrent fluid includes a dye which is a mixture of Red Dye No. 3 and Red Dye. No. 40 in about equal proportions to produce a blood red color.

3. In a self-defense device including container means; and a deterrent fluid including at least one of a lachrymal agent, a dye and an olefactory agent disposed in said container means; said container means being formed of a flexible material having sufficiently thin walls to enable collapsing of said walls by one hand of a user to enable selective discharge of said deterrent fluid by said user for self-defense, said container means further having nozzle means formed to produce a coherent stream of said deterrent fluid upon manual collapsing or said walls, and said container means having removable cap means mounted to said nozzle means to prevent accidental discharge of said deterrent fluid from said container means; the improvement comprising:

said nozzle means include a nozzle shoulder formed in an exterior surface thereof, said cap means is formed as a resiliently displaceable cap having a cap shoulder formed for mating interengagement with and snap-acting release from said nozzle shoulder, and said cap includes securement means coupled to said cap and formed for securement to one of said user and the clothing of said user for removal of said cap by pulling said device away from said securement means.

* * * * *